United States Patent [19]

Collins

[11] 4,049,991

[45] Sept. 20, 1977

[54] LONGITUDINAL RIB EMBOSSMENT IN TRI-APERTURED, SUBSTANTIALLY PLANAR ELECTRODE

[75] Inventor: Floyd K. Collins, Seneca Falls, N.Y.

[73] Assignee: GTE Sylvania Incorporated, Stamford, Conn.

[21] Appl. No.: 731,038

[22] Filed: Oct. 8, 1976

[51] Int. Cl.[2] ..... H01J 29/50; H01J 29/82

[52] U.S. Cl. ..... 313/417; 313/458

[58] Field of Search ..... 313/411, 414, 417, 409, 313/456, 458

[56] References Cited

U.S. PATENT DOCUMENTS

| | | | |
|---|---|---|---|
| 2,810,851 | 10/1957 | Johnson | 313/456 |
| 2,859,378 | 11/1958 | Gundert et al. | 313/414 X |
| 2,888,588 | 5/1959 | Dichter | 313/458 X |
| 3,952,224 | 4/1976 | Evans | 313/414 |

*Primary Examiner*—Robert Segal
*Attorney, Agent, or Firm*—Norman J. O'Malley; Frederick H. Rinn; Robert T. Orner

[57] ABSTRACT

The invention relates to an improved one-piece electrode member for use in an in-line multi-beam cathode ray tube electron gun assembly. The improved electrode has a plurality of spaced apart in-line apertures individually oriented in cup-like depressions which are collectively encompassed by a configurated continuous rim forming a cup encompassing unitized portion within the member. Formed contiguously with each side of the unit is a substantially longitudinal rib embossment having at least one complementary rib projecting therefrom in an angular manner to extend through supporting projections of the electrode. The discretely located conjunctive embossing configurations of the member provide marked strengthening to the in-line structure.

6 Claims, 6 Drawing Figures

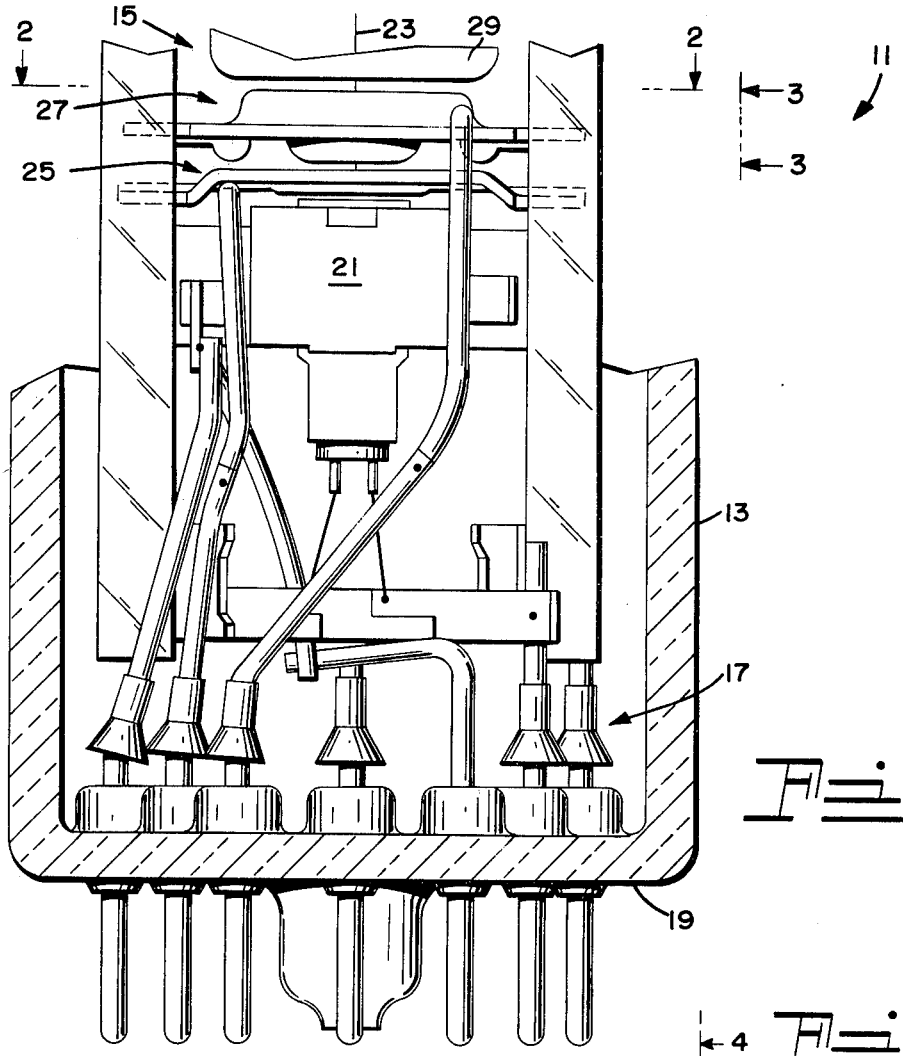
Fig. 1
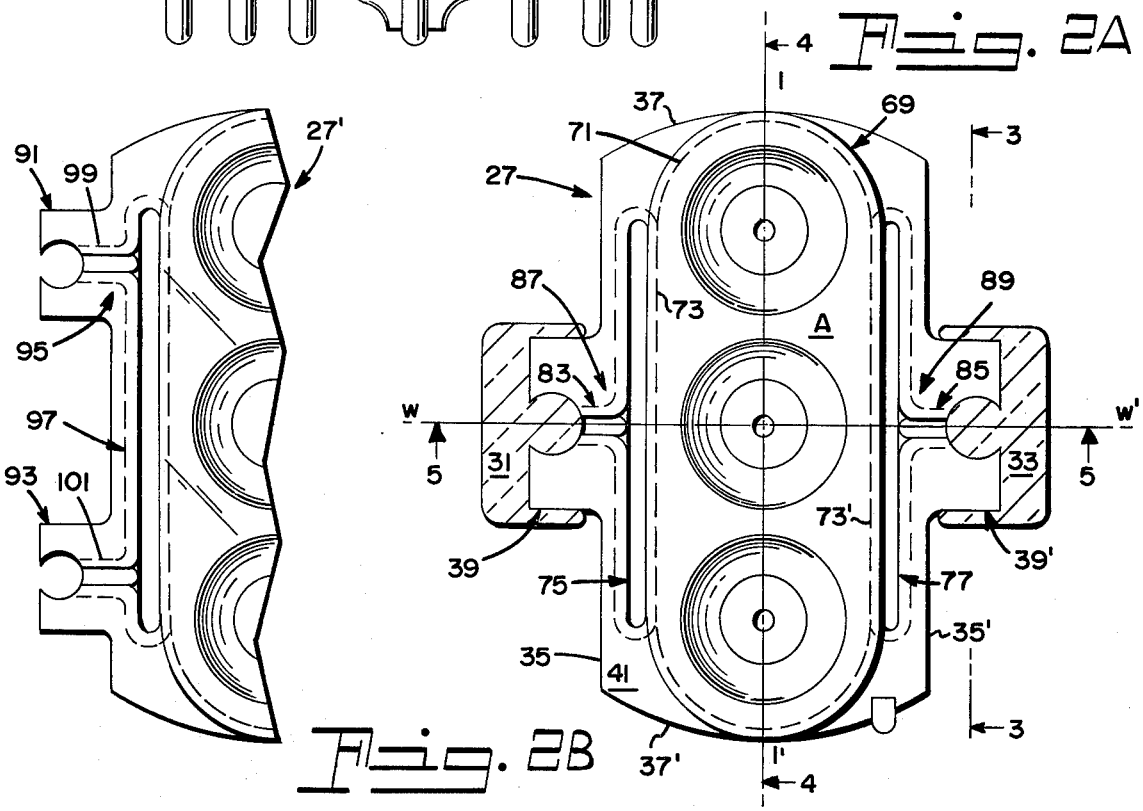
Fig. 2A
Fig. 2B

LONGITUDINAL RIB EMBOSSMENT IN TRI-APERTURED, SUBSTANTIALLY PLANAR ELECTRODE

CROSS-REFERENCE TO RELATED APPLICATION

Filed concurrently with this application and assigned to the assignee of the present invention, is application Ser. No. 731,037, filed Oct. 18, 1976, which also pertains to one-piece in-line multi-beam cathode ray tube electrode structures.

BACKGROUND OF THE INVENTION

This invention relates to the electron gun assembly of a plural beam cathode ray tube and more particularly to ruggedizing improvements in a one-piece electrode member utilized in a multi-beam cathode ray tube electron gun assembly.

Cathode ray tubes, of the type commonly employed in color television applications, conventionally utilize electron gun assemblies from which a plurality of electron beams are projected to impinge the cathodoluminescent display screen of the tube. In certain gun assembly constructions, the first and second grid electrode members, such being normally the control and screen grid electrodes thereof, are often formed as substantially planar components oriented in substantially parallel planes and spaced apart superposed relationship. Conventionally, these electrode members are affixed to at least two longitudinal insulative support members of the gun assembly by supporting projections extending from the sides of the respective planar elements.

In multi-beam guns these planar electrodes commonly have several spatially related apertures formed therethrough to accommodate the respective electron beams generated within the structure. It is important that these several apertures be accurately and consistently spatially located relative to the related apertures of adjacent electrode members, and to the respective cathode surfaces from which the specific electron beams emanate.

Fabrication of the gun assembly involves embedment of the plurality of outwardly extending supporting projections of the respective electrode components into the temporarily heat-softened assembly support means; at which time, the support members on opposed sides of the assembly structure are pressured inward toward the electrode elements thereby forcing the supporting projections thereof into the softened support members. The compressive embedment pressure tends to exert a distorting force upon the several electrode members, this being especially critical to the planar members wherein a bowing or arcuate bending effect sometimes results. Such bowing, however slight, changes the aperture locations relative to those in the adjacent electrode members, thereby producing deleterious inter-electrode spacing relationships within a gun structure. These uncontrollable changes in the related aperture spacings are particularly troublesome in in-line gun constrictions wherein the first and second grid electode members often have related apertures of small diameters and close spacings. Since it is a common practice to utilize planar electrode elements for both the first and second grid electrodes, bowing conditions in one or both drastically aggravates the critical inter-electrode spacing characteristics resulting in pronounced inferior performance of the respective electron guns. Additionally, it has been found that a certain amount of distortion of a planar type electrode member is often aggravated by tube processing procedures and by welding pressures employed in effecting attachment of the electrode component to the associated connective lead in a gun assembly.

OBJECTS AND SUMMARY OF THE INVENTION

It is an object of the invention to reduce and obviate the afore-mentioned disadvantages as evidenced in the prior art. Another object of the invention is to provide a one-piece electrode member having improved ruggedizing structural means therein to counteract distorting forces encountered during electron gun assembly fabrication and subsequent processing procedures.

A further object of the invention is to provide an improved plural electrode in-line multi-beam cathode ray tube electron gun assembly wherein the related grid structures are formed in a manner to optimize the maintenance of initial shaping thereby providing the desired subsequent inter-electrode spacings within the gun structure.

These and other objects and advantages are achieved in one aspect of the invention wherein there is provided an improvement in a plural electrode in-line multi-beam cathode ray tube electron gun assembly integrated by a plurality of longitudinal insulative support means. The invention relates to a one-piece electrode member having opposed side and end portions and definitive 1—1' and *w—w'* axes therein. A plurality of spatially positioned in-line related apertures are individually oriented in cup-like impressions spatially formed on substantially the 1—1' axis of the member. The plurality of aligned aperture cups are treated within the member as a longitudinal unitized portion having a continuous configurated perimeter thereabout. Along each side of the aperture containing portion there is formed a substantially longitudinal rib embossment which has at least one complementary rib projecting outward therefrom in a normal manner to form an angular rib combination which is formed to extend through the supporting projections for the electrode member. These related structural configurations provide defined strengthening of the one-piece electrode member in a manner to expeditiously counteract distorting forces exerted upon the electrode during gun fabrication and tube processing.

BRIEF DESCRIPTION OF THE DRAWINGS

FIG. 1 is a partial elevational illustration of a section of the neck and closure region of a cathode ray tube delineating a portion of the electron gun assembly encompassed therein wherein the improvement of the invention is oriented;

FIG. 2A is a plan view of the improved one-piece electrode structure of the invention taken along the line 2—2 of FIG. 1;

FIG. 2B is a partially sectioned plan view of another embodiment of the improved one-piece electrode structure;

DESCRIPTION OF THE PREFERRED EMBODIMENTS

Figure 3:
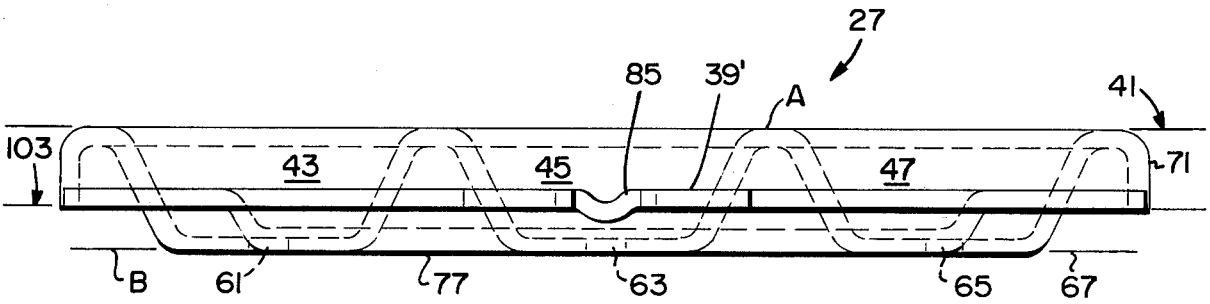
FIG. 3 is a side view of the improved one-piece electrode structure taken along the line 3—3 of FIGS. 1 and 2A.

For a better understanding of the present invention, together with other and further objects, advantages and capabilities thereof, reference is made to the following specification and appended claims in connection with the aforedescribed drawings.

With reference to the drawings, there is shown in FIG. 1 a portion of a typical plural gun in-line color cathode ray tube 11 of the type employed in producing dynamic visual displays such as evidenced in television and allied applications. Positionally encompassed within the neck portion 13 of the tube is a partially illustrated multi-element electron gun assembly 15 wherein a plurality of electron beams are discretely formed and individually projected toward the screen of the tube, not shown. This gun assembly, which is suitably supported on the circular array of metallic pins 17, traversing the closure of the tube 19, is comprised of an arrangement of sequentially related electrode members.

To simplify delineation of the structure, reference is directed to one of the side oriented guns of the in-line assembly, as looking into the plane of FIG. 1, wherein starting with the closure end of the tube 19, a first electrode adjacent thereto is a cathode assembly structure 21 containing an indirectly heated cathode which generates electrons to form the respective beam 23. Sequentially positioned immediately forward therefrom is a control grid electrode 25 which shapes or modulates the electrons into the form of a beam, whereupon it is initially accelerated by the influences of the adjacent screen grid electrode 27. The partially shown third grid electrode 29 provides focusing, and a fourth or high voltage terminal grid electrode, not shown, imparts final velocity or acceleration to the electron beam 23. The aforenoted respective electrode arrangements comprising the exemplary gun assembly are suitably affixed to and supported by a plurality of at least two longitudinal insulative support means, such as members 31 and 33 shown.

In the partially illustrated exemplary electron gun assembly 15, the control electrode member 25 is shown as being a substantially one-piece planar structure. Closely related thereto is a screen grid electrode member 27, which in this instance, is the improved electrode structure of the invention. Due to its discrete configuration, the screen grid member 27 delineates a thickness greater than that of the exemplary control grid electrode. In gun constructions wherein longitudinal space permits, an electrode configurated as the screen grid member of the invention may also be used as a control grid member, such being oriented in inverted relationship.

Figure 4:
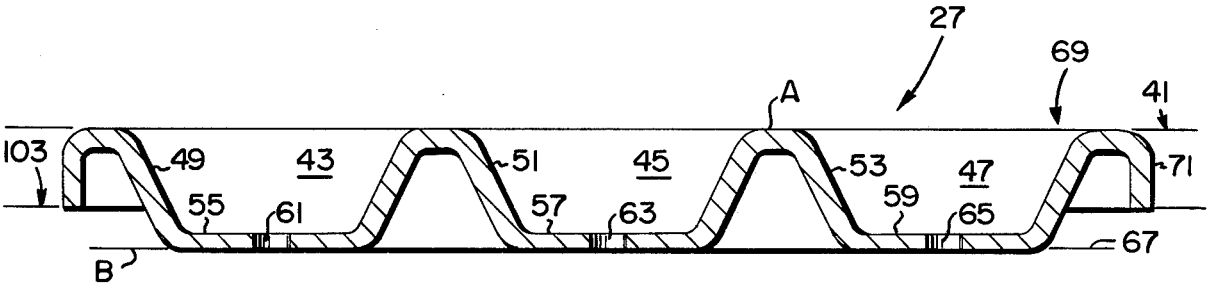
FIG. 4 is a sectional view of the improved electrode structure taken lengthwise along the 1—1' axis or line 4—4 of FIG. 2.
Figure 5:
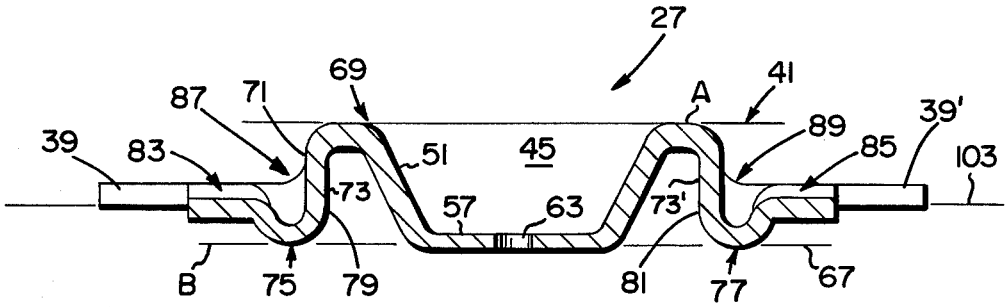
FIG. 5 is a sectional view of the electrode structure taken widthwise along the *w—w'* axis or line 5—5 of FIG. 2A.

In greater detail, reference is directed to FIG. 2A which presents a plan view of the screen grid electrode 27 of the invention. This one-piece metallic member is designated as having opposed side portions 35, 35' and end portions 37, 37'. Additionally, definitive lengthwise 1—1' and widthwise *w—w'* axes are provided to aid in description of the member, whereof the cross-sectional configurations are shown in FIGS. 4 and 5 respectively. In the embodiment shown, the electrode member has at least one supporting projection 39, 39' extending from each side 35 or 35' thereof to provide positional means for attachment of the electrode to the respective assembly supportive means 31 and 33. This affixture is accomplished during electron gun assembly fabrication wherein the longitudinal support members 31, 33, which are usually of glass, are selectively heated to a softened stage; whereupon they are pressed against the carefully positioned electrode supporting projections 39, 39' to consummate firm embedment of the projection within the respective support means.

In referring to FIGS. 3–5, the cross-sectional views designate the several planar levels defined in the construction of the electrode member. As denoted, the alpha planar level 41, which is substantially coincident with surface "A", has a plurality of individual longitudinally aligned cup-like shapings 43, 45 and 47 impressed therein. Each of these cup-like shapings is formed to have a formed sidewall portion 49, 51, 53, which may be tapered as shown, and a substantially flat bottom area 55, 57, 59 containing a respective axially oriented aperture 61, 63, 65 therethrough. The bottoms of the respective cups are oriented in an omega planar level 67 which is substantially coincident with surface "B" and parallelly spaced from the alpha planar level 41. The plurality of aligned cups 43, 45, 47 are treated as a longitudinal unitized portion 69 having a continuous turned perimeter thereabout which defines an encompassing rim 71 extending in a manner substantially normal to the alpha planar level 41. The longitudinal sides 73, 73' of the cup-encompassing portion 69 are substantially parallel with the 1—1' axis. On each side of the member a longitudinal rib or channelized embossment 75, 77 is transitionally configurated from the terminal regions 79 and 81 of the respective longitudinal portions 73 and 73' of the turned perimeter 71 of the cup encompassing unit. From each of the longitudinal channelized embossments 75 and 77 there is at least one complementary rib 83 and 85 projecting outward therefrom in a manner normal thereto to form a rib combination 87, 89. Each of the complementary ribs is oriented to extend through a respective supporting projection 39, 39' which is subsequently embedded in the support means 31, 33 of the assembly. As illustrated in FIG. 2A, each of the longitudinal rib embossments and complementary rib combination constructions is formed as a substantially T-shaped configuration whereof the longitudinal rib 75 or 77 constitutes the spread portion and the respective complementary rib 83 or 85 the rise portion thereof. Also noted in FIGS. 2A and 3, the spread portion 77 of the T-shaped rib combination substantially equals the span between the end-oriented apertures 61 and 65 of the electrode member 27.

Another embodiment of the invention is shown in FIG. 2B wherein the electrode member 27' has two supporting projections 91 and 93 extending from either side thereof. In this modified structure, each of the longitudinal rib embossments and complementary rib combinations 95 are formed as substantially pi ($\pi$) shaped configurations comprised of a longitudinal rib 97 constituting the spread portion and two complementary ribs 99 and 101 the rise portions thereof.

Again referring to the cross-sectional FIGS. 3–5, it is to be noted that the turned perimeter 71 of the cup encompassing portion 69 of the member terminates in a beta planar level 103 intermediate to and parallel with the alpha and omega planar levels 41 and 67. As shown, the beta planar level 103 substantially defines the plane of the supporting projections 39 and 39'. As denoted in FIGS. 3 and 5, the respective outer surfaces of the longitudinal spread portions 75 and 77 of the T-shaped rib combinations 87 and 89 are substantially in the omega planar level 67. The respective sectional views of the complementary rib 85, as noted in FIGS. 3 and 5 show it to be of a depth less than that of the rib embossment 77 of the spread portion of the combination 89.

The aforedescribed conjunctive rib embossments delineated in the electrode structure of the invention are discretely placed to provide a one-piece electrode member evidencing marked ruggedizing structural features which effectively counteract the tranversally-oriented distorting forces encountered during electron gun fabrication and processing. As a result, the electrode structure so constructed maintains its initial shaping and subsequent desired positioning within the electron gun assembly.

While there has been shown and described what are at present considered the preferred embodiments of the invention it will be obvious to those skilled in the art that various changes and modifications may be made therein without departing from the invention as defined by the appended claims.

What is claimed is:

1. An improvement in a plural electrode in-line multibeam cathode ray tube electron gun assembly integrated by a plurality of longitudinal insulative support means, said improvement comprising:

a one-piece electrode member of substantially planar formation having opposed sides and end portions and definitive 1—1' and *w—w'* axes therein, said member having at least one supporting projection extending from each side thereof to provide positional means for attachment of said member to said assembly supportive means; said member having an alpha planar level from which a plurality of individual longitudinally aligned cup-like shapings are impressed, each of said cups having a formed side wall and a substantially flat bottom with an axial aperture therethrough, the bottoms of said cup being oriented in an omega planar level parallelly spaced from said alpha planar level, said plurality of aligned cups being treated within said member as a longitudinal unitized portion having a continuous turned-perimeter thereabout defining an encompassing rim extending normal to said alpha planar level, the longitudinal sides of said cup-encompassing portion being parallel with said 1—1' axis, said electrode member having a substantially longitudinal rib embossment formed on either side thereof, with at least one complementary rib projecting outward therefrom in a normal manner to form a rib combination, each of said longitudinal rib embossments being transitionally configurated from the terminal region of the respective longitudinal portion of the turned perimeter of said cup encompassing unit, the complementary rib means of said combination being oriented to extend through each of said supporting projections.

2. The improved one-piece electrode member according to claim 1 wherein each of said longitudinal rib embossment and complementary rib combinations is formed as a substantially T-shaped configuration whereof said longitudinal rib constitutes the spread portion and said complementary rib the rise portion thereof.

3. The improved one-piece electrode member according to claim 2 wherein said turned perimeter terminates in a beta planar level intermediate to and parallel with said alpha and omega planar levels, said beta planar level being the level of said supporting projections.

4. The improved one-piece electrode member according to claim 2 wherein the outer surface of the spread portion of said T-shaped rib is substantially in said omega planar level.

5. The improved one-piece electrode member according to claim 2 wherein the complementary rib formed in said rise portion is of a depth less than that of the rib in said spread portion.

6. The improved one-piece electrode member according to claim 1 wherein said member has two spaced-apart supporting projections extending from either side thereof, and wherein each of said longitudinal rib embossments and complementary rib combinations are formed as substantially pi ($\pi$) shaped configurations comprised of a longitudinal rib constituting the spread portion and two complementary ribs the rise portions thereof, the outer surface of said spread portion being substantially in said omega planar level, and said complementary rib rise portions being oriented substantially in a beta planar level intermediate to and parallel with said alpha and omega planar levels.

* * * * *